US009115510B2

(12) United States Patent
Le

(10) Patent No.: US 9,115,510 B2
(45) Date of Patent: Aug. 25, 2015

(54) SEALED LEVER LATCH

(71) Applicant: S.P.E.P. ACQUISITION CORP., Long Beach, CA (US)

(72) Inventor: Tam Le, Santa Ana, CA (US)

(73) Assignee: S.P.E.P. Acquisition Corp., Long Beach, CA (US)

( * ) Notice: Subject to any disclaimer, the term of this patent is extended or adjusted under 35 U.S.C. 154(b) by 235 days.

(21) Appl. No.: 13/909,442

(22) Filed: Jun. 4, 2013

(65) Prior Publication Data

US 2014/0352223 A1 Dec. 4, 2014

(51) Int. Cl.

| | |
|---|---|
| ***E05C 3/02*** | (2006.01) |
| ***E05B 17/00*** | (2006.01) |
| ***E05C 3/04*** | (2006.01) |
| *E05B 63/06* | (2006.01) |
| *E05B 13/10* | (2006.01) |

(52) U.S. Cl.

CPC ..... *E05B 17/002* (2013.01); *E05C 3/048* (2013.01); *E05B 13/10* (2013.01); *E05B 17/0025* (2013.01); *E05B 63/06* (2013.01); *Y10T 292/1075* (2015.04); *Y10T 292/48* (2015.04); *Y10T 292/57* (2015.04)

(58) Field of Classification Search

USPC ..... 292/194, DIG. 30, DIG. 31

See application file for complete search history.

(56) References Cited

U.S. PATENT DOCUMENTS

| | | | | |
|---|---|---|---|---|
| 4,510,779 | A * | 4/1985 | Ahad | 70/208 |
| 5,820,174 | A * | 10/1998 | Parikh et al. | 292/126 |
| 6,174,007 | B1 * | 1/2001 | Schlack et al. | 292/336.3 |
| 8,646,819 | B2 * | 2/2014 | Do et al. | 292/228 |

* cited by examiner

*Primary Examiner* — Mark Williams

(74) *Attorney, Agent, or Firm* — Karish & Bjorgum PC

(57) ABSTRACT

A sealed lever latch. It has a handle with a pivot end with a non-round bore passing therethrough, a housing having a well with a narrowed end with spaced apart sidewalls with holes, the narrowed end sized to receive the pivot end of the handle. A lever carriage with two spaced apart arms straddles the sidewalls of the narrowed end of the housing and each arm has a first engagement. A drive pin unit has a first keeper, a drive pin with a non-round profile extending from the first keeper, and a second keeper that engages with a free end of the drive pin. The keepers non-rotatably engage with the first engagements of the lever carriage arms and with the drive pin non-rotatably passing through the non-round bore in the pivot end of the handle to connect the handle and the lever carriage together. Seals are placed on the drive pin unit between the first and second keeper ride adjacent to the holes in the sidewalls of the housing to prevent passage of liquid or debris therethrough.

17 Claims, 8 Drawing Sheets

SEALED LEVER LATCH

BACKGROUND

The invention relates to latches for doors and panels, and more particularly to a sealed lever latch that is weatherproof and resists ingress of liquid and debris through the latch.

There are a wide variety of lever latches on the market. Some purport to be weatherproof, and provide various method and designs to help prevent liquid and debris from passing through the latch and into the door or other panel. Some such designs are disclosed in U.S. Pat. Nos. 5,267,762, 5,609,373 and U.S. Pat. No. 5,664,813. However, these prior art lever latches are of unnecessary design complexity and do not provide completely weatherproof latches.

SUMMARY OF THE INVENTION

A sealed lever latch, comprising:

a handle with a pivot end having two opposite faces and non-round bore passing therethrough, and a paddle portion opposite the pivot end;

a housing having a well with a narrowed end with spaced apart sidewalls, the narrowed end being sized to rotatably receive the pivot end of the handle, the narrowed end having a through hole formed through the spaced apart sidewalls and aligned to receive the non-round bore in the pivot end of the handle;

a lock pivot that is pivotally mounted to the handle and which is adapted to selectively retain the handle in a first position where the paddle portion of the handle is retained close to the housing, and a second position where the paddle portion of the handle swings away from the housing;

a lever carriage having two spaced apart arms which arms straddle the outside of the spaced apart sidewalls of the narrowed end of the housing, each arm having a first engagement formed therein;

a fastener lever extending from the lever carriage below the housing;

a drive pin unit with a first keeper, a drive pin with a non-round profile extending from the first keeper, and a second keeper adapted to be engaged with a free end of the drive pin, wherein the first and second keepers non-rotatably engage with the first engagements of the lever carriage arms and the drive pin non-rotatably passes through the non-round bore in the pivot end of the handle; and seals placed on the drive pin unit between the first and second keeper, which seals rides adjacent to the thorough holes in the sidewalls of the housing to prevent passage of liquid or debris therethrough.

A sealed lever latch, comprising:

a handle with a pivot end with a non-round bore passing therethrough, and a paddle portion opposite the pivot end;

a housing having a well with a narrowed end with spaced apart sidewalls, the narrowed end sized to receive the pivot end of the handle, the narrowed end having holes formed through the spaced apart sidewalls;

a lever carriage having two spaced apart arms adapted to straddle the sidewalls of the narrowed end of the housing, at least one arm having a first engagement;

a drive pin unit with a first keeper, a drive pin with a non-round profile extending from the first keeper, and a second keeper adapted to be engaged with a free end of the drive pin, wherein at least one of the first and second keepers non-rotatably engage with the at least one first engagement of the lever carriage arms and wherein the drive pin non-rotatably passes through the non-round bore in the pivot end of the handle to connect the handle and the lever carriage together; and seals placed on the drive pin unit between the first and second keeper, which seals ride adjacent to the holes in the sidewalls of the housing to prevent passage of liquid or debris therethrough.

DETAILED DESCRIPTION OF THE INVENTION

Figure 1A:
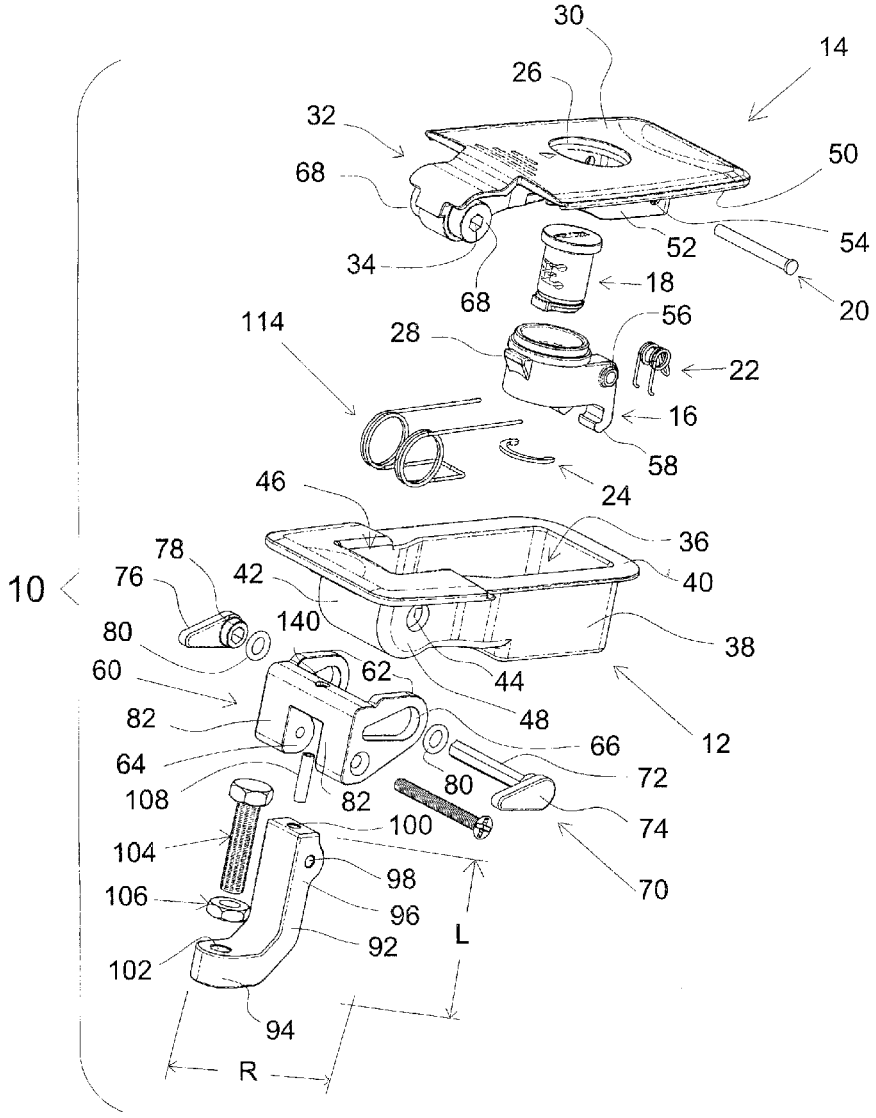
FIG. 1A is an exploded view of an exemplary embodiment of a sealed lever latch of the invention showing its main components.
Figure 1B:
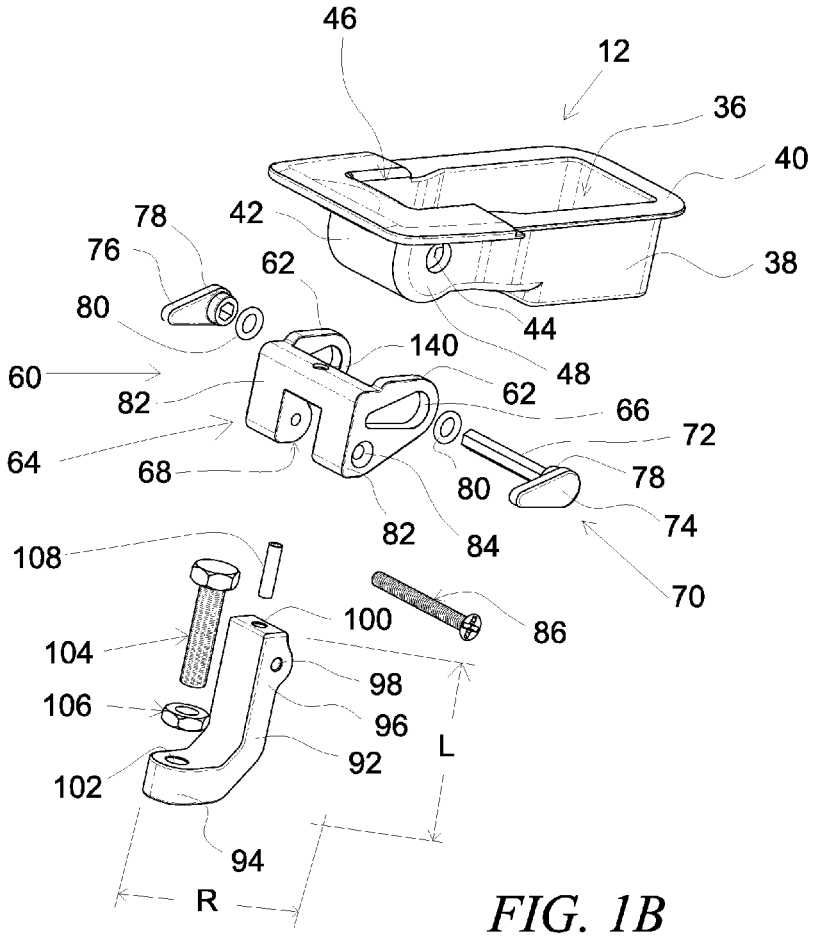
FIG. 1B is detail exploded view showing the housing and parts below the housing of the sealed lever latch of FIG. 1A.
Figure 3:
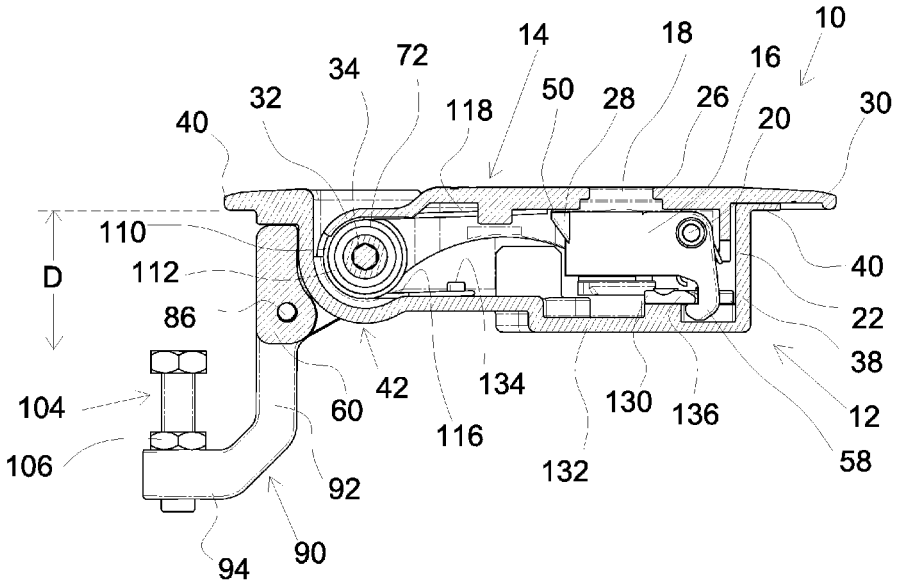
FIG. 3 is a first, longitudinal partial cross-sectional view through view lines 3-3 of FIG. 2 showing portions of the handle, the housing, and lever carriage of the sealed lever latch of the invention.
Figure 4:
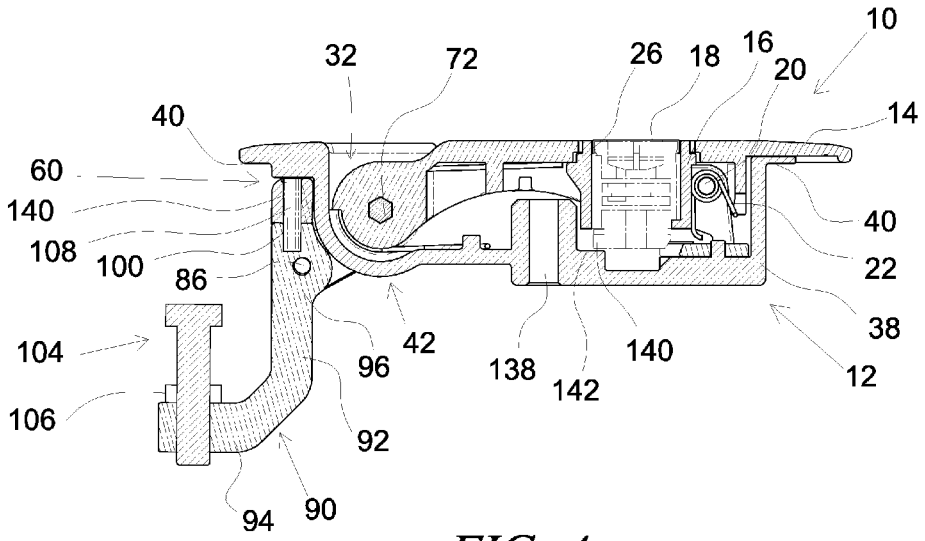
FIG. 4 is a second, longitudinal cross-sectional view through view lines 3-3 of FIG. 2 showing additional features of the sealed lever latch of the invention.
Figure 5:
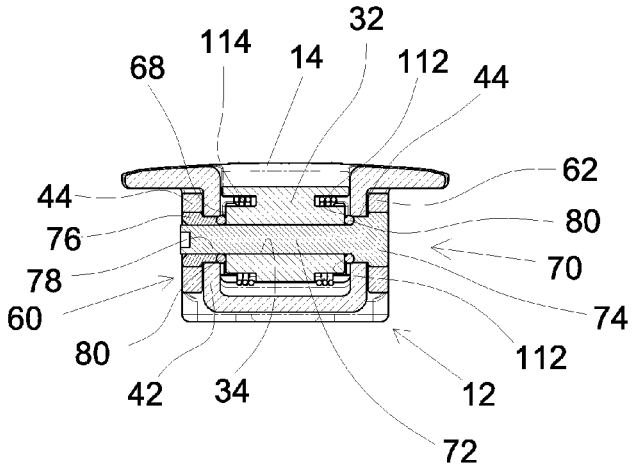
FIG. 5 is transverse cross-sectional view through view lines 5-5 of FIG. 2.
Figure 9:
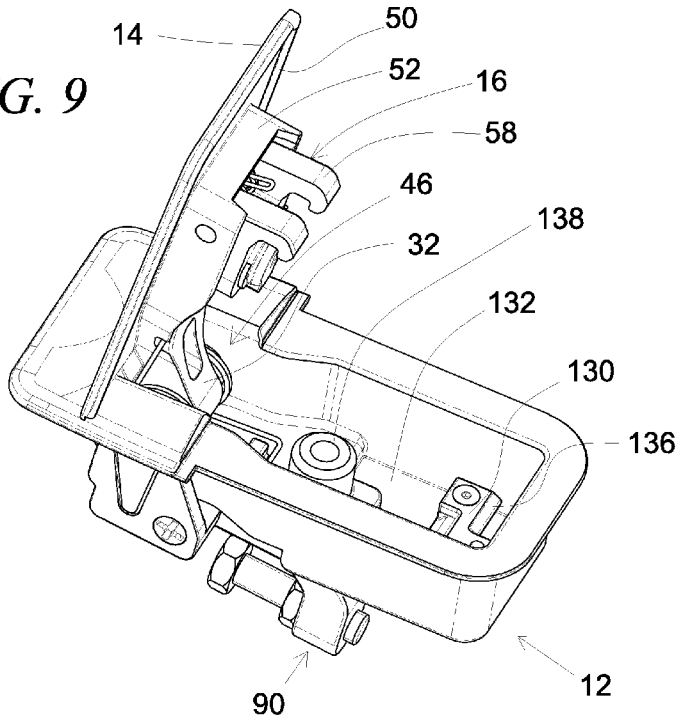
FIG. 9 is a top front right perspective view of the sealed lever latch of FIG. 2 with its handle in an opened state.

FIGS. 1A and 1B are an exploded view of an exemplary embodiment of a sealed lever latch 10 of the invention showing its main components. FIG. 1A shows all parts of the sealed lever latch 10 while FIG. 1B shows only the housing 12 and parts located below the housing. The sealed lever latch 10 includes a housing portion 12, a handle 14, a lock pivot 16, a key lock 18 that fits within the lock pivot 16, a pivot pin 20 that pivotally retains the lock pivot 16 to the housing 14, a lock pivot spring 22 that biases the lock pivot 16 to closed position, and a keeper clip 24 that retains the key lock 18 within the lock pivot 16. The handle 14 has a paddle end 30 and a pivot end 32 with two opposite faces 68 and having a non-round bore 34 formed therethrough. The opposite faces 68 are preferably parallel to each other. The paddle end 30 has a key lock aperture 26 formed therethrough for access to the key lock 18. The lock pivot 16 further includes a stop 28, the function of which will be explained below. The housing has a well 36 with sidewalls 38 and a perimeter seating rim 40. The housing 14 will fit through an opening formed in a door or panel (not shown) with the perimeter seating rim 40 providing a seal around the opening. The housing 14 has a narrowed end 42 with a through hole 44 formed therethrough. The narrowed end 42 of the housing 14 has an inner space 46 and outer walls 48. On an underside 50 of the handle 14 is a lock pivot support 52 with a pivot pin hole 54 that receives the pivot pin 20 that passes into a through hole 56 on the lock pivot 16. The lock pivot 16 has at least one finger 58, the function of which will be described below. The pivot end 32 of the handle 14 is sized to be pivotally received in the inner space 46 when the sealed lever latch 10 is fully assembled. A lever carriage 60 with two spaced apart arms 62 and a fastener lever receiver 64 are provided. Located in at least one arm 62 (and preferably both arms) are engagements, in the form of openings 66 formed in the arms 62. A drive pin unit 70 has a drive pin 72 that extends from a first keeper 74 that is adapted to engage with the opening 66 in the arm 62. The drive pin 72 has a cross-section that is adapted to be non-rotatably received in the non-round bore 34 of the pivot end 32 of the handle 14. While shown as being hexagonal, the drive pin 72 can have other non-round profiles. The first keeper 74 and drive pin 72 can be formed as a single unit or can be permanently attached together. A second keeper 76 fits on an opposite end of the drive pin 72. The first and second keepers 74 and 76, respectively, are adapted to engage with the engagements/openings 66 of the arms 62. Although the openings 66 and the first and second keepers 74 and 76, respectively, are shown as being generally tear-drop shaped, they can have any desired shape that ensures that the lever carriage 60 and drive pin unit 70 are locked together and move in concert, to thereby prevent the drive pin 72 from rotating relative to the leverage carriage. Each keeper 74 and 76 has an inner facing collar 78. The collars 78 have inwardly facing surfaces that face the outer walls 48 of the narrowed end 46 of the housing 14. Resilient yet flexible seals 80, such as O-rings, will be slide onto the drive pin 72 between the each collar 78 of the keepers 74 and 76 and the outer walls 48 of the narrowed end 46 of the housing 14, as best shown in FIG. 5. The drive pin unit 70 is preferably permanently fixed in place by, for example, a rivet end of the drive pin 72 being peened over into the second keeper 76, thereby securing the drive pin unit 70, lever carriage 60, and handle 14 together, with the seals 80 providing for the desired waterproof seal between the housing 12 and handle 14. When assembled, this arrangement of seals 80 riding on the outer walls 48 of the narrowed end 46 of the housing 14 and against the collars 78 of the keepers 74 and 76 will provide a simple yet effective seal to prevent the passage of any liquid or debris via the through hole 44 formed in the well 36 of the housing 14. Since the seals 80 provide some give, any minor variances in sizes of the other pieces of the sealed lever latch will be taken up by the seals 80, and the movement of the handle 14 relative to the housing will be smooth and unimpeded. Turning back to the lever carriage 60, its fastener lever receiver 64 is adapted to connect to a fastener lever 90. The fastener lever 90 has a length L along a longitudinal portion 92 and a reach R of an arm portion 94. At an upper end 96 of the longitudinal portion 92 is a through hole 98 and a pin hole 100. A threaded hole 102 is formed at the arm portion 94. A threaded adjustment bolt 104 and nut 106 can be used to set a working length of the fastener lever 90. A retention pin 108 is used to retain an upper end of the fastener lever 90 to the lever carriage 60. In lieu of having a retention pin 108 fitting into pin hole, the upper end 96 of the fastener lever 90 can be shaped to fit into a complementary shaped opening 68. Turning to the lever carriage 60, its fastener lever receiver 64 comprises an opening located between two extensions 82. A hole 84 passes through the two extensions 82. Not shown in FIGS. 1A and 1B, is a complementary pin hole 140 formed in the lever carriage that is aligned to receive the retention pin 108 when it is engaged with the pin hole 100 in the fastener lever 90, and the fastener lever 90 is positioned in the opening 68 between the two extensions 82, and is screwed in place with a bolt 86. Depending on the door or panel thickness, the frame dimensions, the spacing between the door and frame, and other considerations, the fastener lever 90 selected for use with the sealed lever latch 10 must have an appropriate length L and reach R. Thus, the design of the sealed lever latch 10 allows a single unit to be provided that just needs the fastener lever 90 with the desired length L and reach R. Also, instead of having a separate fastener lever 90 as described above, it is possible to incorporate a fastener lever that is unitary with the carriage lever 60, and provide for different lengths L and reaches R by changing out the combination carriage lever/fastener lever. Lastly, a handle spring 110 is provided. The pivot end 32 of the handle 14 has two generally cylindrical-shaped ends 112 through which the non-round bore 34 extends. The handle spring can preferably have two spaced apart spring loops 114 joined by a spring keeper 116 that seats on a floor (as shown in FIGS. 3, 4, and 9) of the housing 12. Free ends 118 extend from each spring loop 114 and will ride on an underside of the handle 14, as best shown in FIGS. 2, 3, 4, and 7-10) and act to bias the handle 14 to an opened position, as shown in FIGS. 7-12.

The precise manner in which the fastener lever 90 engages with the carriage lever 60 can be modified. However, the design as described herein, with its drive pin unit 70 separate from the lever carriage 60 provides for a simple yet robust design that both provides a reliable seal yet does not interfere with the smooth operation of the sealed lever latch. As thusly described, in response to pivotal movement of the handle 14 in the housing 12, the drive pin unit 70 will rotate the lever carriage 60 and its attached fastener lever 90.

Figure 2:
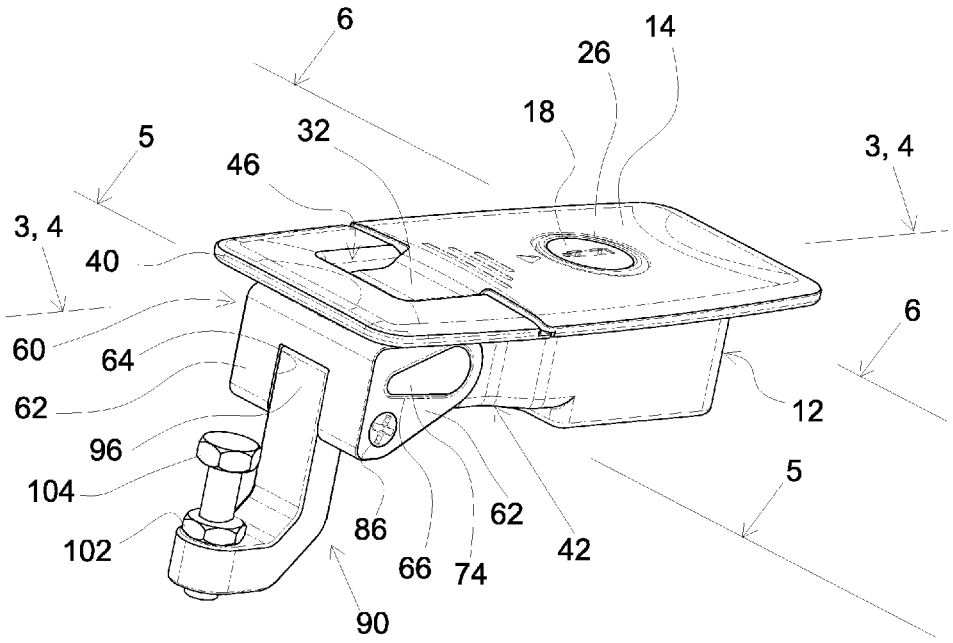
FIG. 2 is a perspective view of the sealed lever latch of FIG. 1 in its assembled state.

FIG. 2 is a perspective view of the sealed lever latch 10 of FIG. 1 in its assembled state. As shown, the handle 14 is in its closed position where it is generally flush with the top of the housing 12. The lever carriage 60 is pivotally positioned around the pivot end 42 of the housing 12 and the fastener lever 90 is connected to the lever carriage 60. By turning the adjustment bolt 104 in the threaded hole 102 in the arm portion 94, and locking the bolt's position in place with the nut 106, the working distance D of the threaded adjustment bolt 104 can be made. The key lock 18 is shown protruding through the key lock aperture 26, and the perimeter seating rim 40 of the housing 12 is also shown.

FIG. 3 is a first, longitudinal partial cross-sectional view through view lines 3-3 of FIG. 2 showing the housing 12, the handle 14, the lever carriage 60 of the sealed lever latch 10, and FIG. 4 is a second, longitudinal cross-sectional view through view lines 3-3 of FIG. 2 showing additional features of the sealed lev86latch 10 of the invention. The lock pivot 16 with its carried key lock 18 held in place by the keeper clip 24 are shown, as is the pivot pin 20 and the lock pivot spring 22 which biases the lock pivot 16 so that its stop 28 will hit the underside 50 of the handle 14. The paddle end 30, pivot end 32, non-round bore 34, and cylindrical-shaped end 112 are shown, with the drive pin 72 connecting together the handle 14 to the lever carriage 60. The sidewall 38 and perimeter seating rim 40, and narrowed end 42 of the housing 12 are shown. The housing 12 has a floor 132 and retainer 134 which retains the spring keeper 116. The free ends 118 of the handle spring 110 ride on the underside of the handle 14 and bias it to the opened position (as shown in FIGS. 7-12.) A catch 130 is attached to the floor 132 of the housing and as a lip 136 which is adapted to retain fingers 58 of the lock pivot 16. A mounting hole 138 is formed through the floor 132 of the housing 12. The mounting hole 138 is used to permit a mounting bolt and bracket (not shown) to be used to compress the rim 40 of the housing against the perimeter of a lock opening formed in a door or panel (not shown.) Unless and until the lock pivot 16 is depressed, the lock pivot spring 22 will bias the lock pivot to the closed position and keep the fingers 58 locked onto the lip 136 of the catch 130. The retention pin 108 is shown retained in the pin hole 100 of the fastener lever 90 and passing through the complementary pin hole 140 in the lever carriage 60. The bolt 86 passes through the upper end 96 of the fastener lever 90 where the bolt 86 provides a second attachment point of the fastener lever 90 to the lever carriage 60. The threaded bolt 104, the nut 106 are shown passing through the arm portion 94 of the lever carriage 60. By varying the length of the longitudinal portion 92 and the arm portion 94, and the position of the threaded adjustment bolt 104, the working reach of the latch can be customized to the particular needs of the application, and in particular the working distance "D" can be adjusted. Referring back to FIGS. 1, and 2 and 3, a protruding cam 142 is located at the bottom of the key lock 18. The protruding cam 142 protrudes laterally from the bottom the key lock more than other parts. When the key lock 18 is turned, the protruding cam 142 likewise turns. In a locked position, as shown in FIGS. 2 and 3, the protruding cam 140 will be aligned to be directly located over a housing step 142 extending from the floor 132 of the housing. In this locked position of the key lock 18 and its protruding cam 140, if a user tries to depress the lock pivot 16, then protruding cam 140 will impinge on the housing step 142 and prevent the lock pivot from 16 from being pushed down so that the fingers 58 on the lock pivot 16 will disengage from the catch 130, and thereby prevent the handle 14 from being freed to an open position as shown in FIGS. 7-12. Moreover, this design allows the key lock 18 to be put into the locked position even when the handle 14 is in the opened position.

FIG. 5 is transverse cross-sectional view of the of the sealed lever latch 10 through view lines 5-5 of FIG. 2. The housing 12 and handle 14 are shown, and the seals 80 are shown positioned in place on the drive pin unit 70, with the drive pin 72 passing through the through hole 44 in the pivot end 32 of handle 14, and then engage with the non-round bore 34 in the cylindrical-shaped ends 112 of pivot end 32 of handle 14 to engage together the handle 14 and the lever carriage 60. The two spaced apart spring loops 114 are shown around the cylindrical-shaped ends 112 of pivot end 42 of the handle 14. The arms 62 of the lever carriage 60 will ride closely next to the pivot end 42 of the housing 12. The seals 80 will bear against the collars 78 on the first keeper 74 and second keep 76 and water-tightly ride on the opposite faces 68 of the cylindrical-shaped ends 112 of pivot end 32 of handle 14 as well as ride against the through hole 44 in the sidewalls of the housing. This design effectively provides a water-tight seal between the moving parts without adding much frictional resistance to the unit that would impede the handle 14 from freely pivoting. Likewise, the seals 80 are adapted to accommodate for relatively wide tolerances in the separate pieces making up the sealed lever latch 10. Finally, the design resists wear and tear on the seal 80 and its connected parts, ensuring good operation of the sealed lever latch 10 over the long term.

Figure 6:
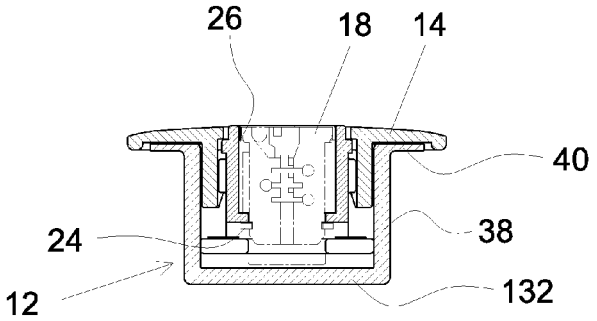
FIG. 6 is transverse cross-sectional view through view lines 6-6 of FIG. 2.

FIG. 6 is transverse cross-sectional view of the of the sealed lever latch 10 through view lines 6-6 of FIG. 2. The key lock 18 is shown retained in the key lock aperture 26 with the keeper clip 24. In the exemplary sealed lever latch 10, the handle 14 may partially overlay the perimeter seating rim 40. The sidewalls 38 and floor 132 of the housing 12 are shown.

Figures 7, 8:
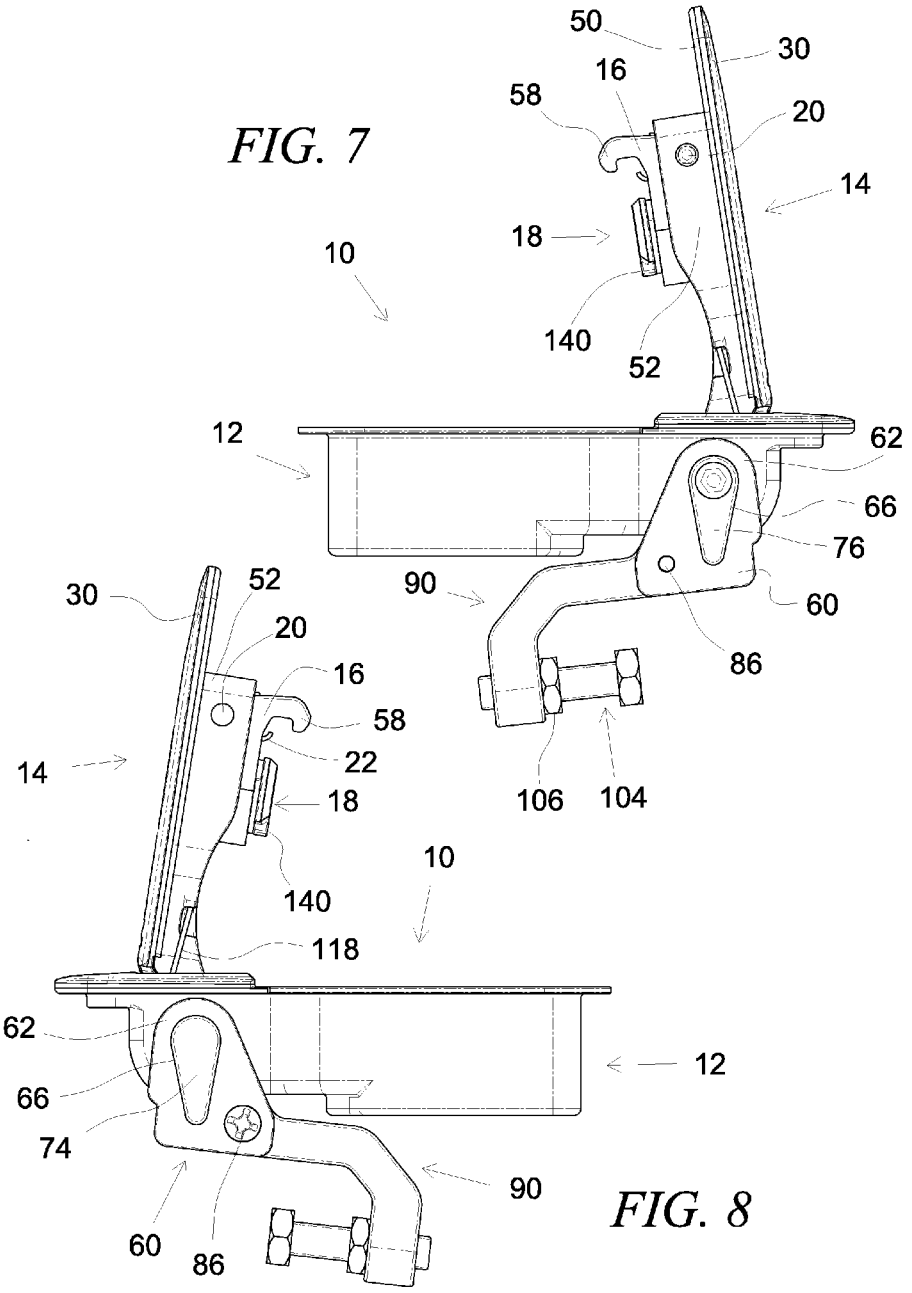
FIG. 7 is a right side view of the sealed lever latch of FIG. 2 with its handle in an opened state.
FIG. 8 is a left side view of the sealed lever latch of FIG. 2 with its handle in an opened state.

FIG. 7 is a right side view and FIG. 8 is a left hand side view of the sealed lever latch 10 of FIG. 2 with its handle 14 in an opened state and with its paddle end 30 extending outside of the housing 12. The protruding cam 140 on the bottom of the key lock 18 is shown. By rotating the key lock 18, the axial position of the protruding cam 140 can be moved. The fingers 58 on the lock pivot 16 are also shown, along with a portion of the lock pivot spring 22 that biases the lock pivot 16 to the closed position. The lock pivot support 52 is shown extending below the underside 50 of the handle 14, with the pivot pin 20 carrying the lock pivot 16. The free ends 118 of the handle spring bias the handle 14 to its open position shown. Also shown are the lever carriage 60, its two spaced apart arms 62 with openings 66 formed therein, with the first keeper 74 and second keeper 76 in place. The bolt 86 holds the fastener lever 90 to the lever carriage 60. In the opened state, the fastener lever and its carried threaded adjustment bolt 104 and nut 106 are shown swung back under the housing 12. In this position, the door or panel (not shown) to which the sealed lever lock 10 is attached can be freely opened.

Figure 10:
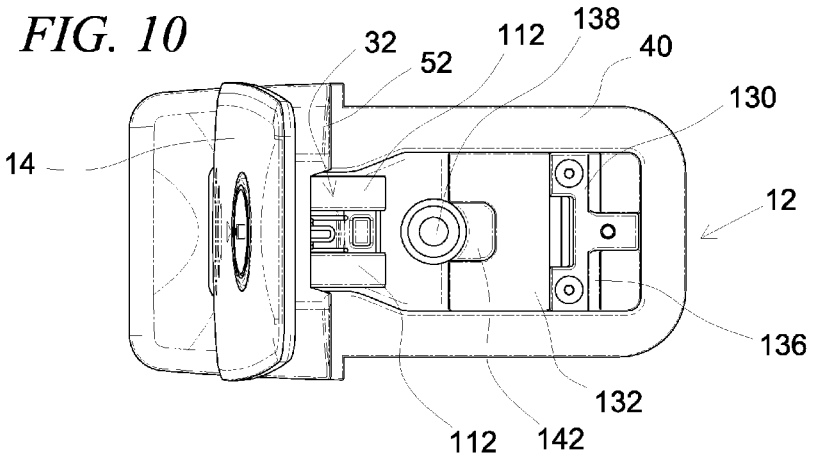
FIG. 10 is a top view of the sealed lever latch of FIG. 2 with its handle in an opened state.

FIG. 9 is a top front right perspective view of the sealed lever latch 10 of FIG. 2 with its handle 14 in an opened state, and FIG. 10 is a top view of same. The catch 130 with its lip 136 is shown mounted to the floor 132 of the housing 12, and the mounting hole 138 is shown. The pivot end 32 of the handle 14 is shown closely fitting into the inner space 46 of the housing 12. The fingers 58 on lock pivot 16 will catch on the lip 136 of the catch 130. The lock pivot support 52 is shown on the underside 50 of the handle 15. The housing step 142 on the floor 132 of the housing 12 are shown. The cylindrical-shaped ends 112 of pivot end 32 of handle 14 are shown in the inner space 46 of the housing 12.

Figure 11:
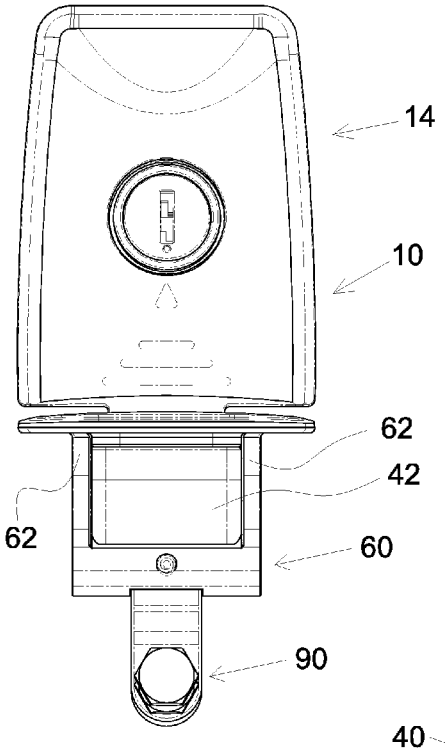
FIG. 11 is a front view of the sealed lever latch of FIG. 2 with its handle in an opened state.
Figure 12:
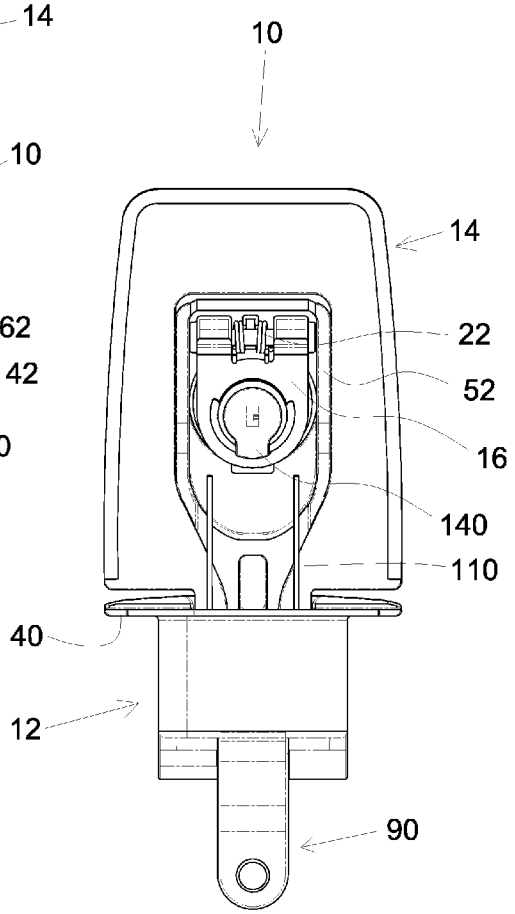
FIG. 12 is a rear view of the sealed lever latch of FIG. 2 with its handle in an opened state.

FIG. 11 is a front view of the sealed lever latch 10 of FIG. 2 with its handle in an opened state and FIG. 12 is a rear view of same. The handle 14 biased by the handle spring 110 out of housing 12 and the lock pivot 16 with its carried key lock 18 are biases to the closed position by the lock pivot spring 22. In FIG. 12, the protruding cam 140 on the bottom of the key lock 18 can be viewed. The lever carriage 60 and its carried fastener lever 9 are shown. The lock pivot support 52 is shown on the underside 50 of the handle 14. The two spaced apart arms 62 of the lever carriage are shown sandwiching the narrowed end 42 of the housing 12.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention.

What is claimed is:

1. A sealed lever latch, comprising:

a handle with a pivot end having two opposite faces and non-round bore passing through the pivot end through the two opposite faces, and a paddle portion opposite the pivot end;

a housing having a well with a narrowed end with spaced apart sidewalls, the sidewalls having inner surfaces and outer surfaces, the narrowed end being sized to rotatably receive the pivot end of the handle, the narrowed end having a through hole formed through the spaced apart sidewalls and aligned to receive the non-round bore in the pivot end of the handle;

a lock pivot that is pivotally mounted to the handle and which is adapted to selectively retain the handle in a first position where the paddle portion of the handle is retained close to the housing, which first position corresponds to a locked position of the handle and the sealed lever latch, and a second position where the paddle portion of the handle swings away from the housing, which second position corresponds to an unlocked position of the handle and the sealed lever latch;

a lever carriage having two spaced apart arms which arms straddle the outside of the spaced apart sidewalls of the narrowed end of the housing, each arm having a first engagement formed therein;

a fastener lever extending from the lever carriage below the housing;

a drive pin unit with a first keeper, a drive pin with a non-round profile extending from the first keeper, and a second keeper adapted to be engaged with a free end of the drive pin, wherein the first and second keepers non-rotatably engage with the first engagements of the lever carriage arms and the drive pin non-rotatably passes through the non-round bore in the pivot end of the handle; and seals placed on the drive pin unit between the first and second keeper, which seals rides adjacent to the through holes in the sidewalls of the housing to prevent passage of liquid or debris through the through holes.

2. The sealed lever latch of claim 1, wherein the first and second keepers each further includes an inwardly facing generally cylindrical collar, which generally cylindrical collars are sized to rotatably pass through the through holes in the sidewalls of the housing, and provide for sealing between the drive pin unit, the handle, and the housing.

3. The sealed lever latch of claim 1, further comprising a lock pivot spring that biases the lock pivot to a position where it retains the handle in the first position where the paddle portion of the handle is retained close to the housing, which position corresponds to the locked position of the handle, and by depressing the lock pivot, it allows the paddle portion of the handle swings away from the housing, which position corresponds to the unlocked position of the handle.

4. The sealed lever latch of claim 3, wherein the lock pivot further comprises fingers on a bottom of the lock pivot, which fingers are adapted to detachably engage with a catch attached to a floor of the housing, and which fingers will disengage with the catch when the lock pivot is depressed.

5. The sealed lever latch of claim 1, wherein the first engagements in each arm of the lever carriage comprises a non-round hole formed through each arm, and wherein the first and second keepers non-rotatably fit one each into the two first engagement, and wherein the free end of the drive pin is peened over to retain the first and second keepers in the non-round holes in the arms.

6. The sealed lever latch of claim 1, further comprising a handle spring that biases the handle to the second position where the paddle portion of the handle swings away from the housing.

7. The sealed lever latch of claim 1, further comprising a key lock that engages with lock pivot and can be selected locked and unlocked, and wherein in the locked mode when the handle is in the first position, the lock pivot will be prevented from being depressed so that the handle cannot move to the second position where the paddle portion of the handle swings away from the housing.

8. The sealed lever latch of claim 1, wherein the lever carriage and the fastener lever extending from the lever carriage are separate components, and fastener lever is detachably attached to the lever carriage via a bolt and pin, and the fastener lever can be provided in a length and reach as desired for a particular application.

9. The sealed lever latch of claim 8, wherein the a lever carriage has two spaced apart extensions with a space therebetween into which an end of the fastener lever fits, and with a bolt passing through the two spaced apart extensions and the end of the lever to retain the lever carriage and the fastener lever.

10. A sealed lever latch, comprising:

a handle with a pivot end with a non-round bore passing through the pivot end, and a paddle portion opposite the pivot end;

a housing having a well with a narrowed end with spaced apart sidewalls, the narrowed end sized to receive the pivot end of the handle, the narrowed end having holes formed through the spaced apart sidewalls;

a lock pivot that is pivotally mounted to the handle and which is adapted to selectively retain the handle in a first position where the paddle portion of the handle is retained close to the housing, which first position corresponds to a locked position of the handle and the sealed lever latch, and a second position where the paddle portion of the handle swings away from the housing, which second position corresponds to an unlocked position of the handle and the sealed lever latch;

a lever carriage having two spaced apart arms adapted to straddle outer surfaces of the sidewalls of the narrowed end of the housing, at least one arm having a first engagement;

a drive pin unit with a first keeper, a drive pin with a non-round profile extending from the first keeper, and a second keeper engaged with a free end of the drive pin, wherein at least one of the first and second keepers non-rotatably engage with the at least one first engagement of the lever carriage arms and wherein the drive pin non-rotatably passes through the non-round bore in the pivot end of the handle to connect the handle and the lever carriage together; and seals placed on the drive pin unit between the first and second keeper, which seals ride adjacent to the holes in the sidewalls of the housing to prevent passage of liquid or debris through the holes in the sidewall of the housing.

11. The sealed lever latch of claim 10, further comprising a fastener lever extending from the lever carriage below the housing.

12. The sealed lever latch of claim 10, wherein the first and second keepers each further includes an inwardly facing generally cylindrical collar, which generally cylindrical collars are sized to rotatably pass through the through holes in the sidewalls of the housing, and provide for sealing between the drive pin unit, the handle, and the housing.

13. The sealed lever latch of claim 10, wherein the first engagements in each arm of the lever carriage comprises a non-round hole formed through each arm, and wherein the first and second keepers non-rotatably fit one each into the two first engagement, and wherein the free end of the drive pin is peened over to retain the first and second keepers in the non-round holes in the arms.

14. The sealed lever latch of claim 10, further comprising a handle spring that biases the handle to the second position where the paddle portion of the handle swings away from the housing, and a lock pivot spring that biases the lock pivot to a position where it retains the handle in the first position where the paddle portion of the handle is retained close to the housing, and by depressing the lock pivot, it allows the paddle portion of the handle swings away from the housing, and wherein the lock pivot further comprises a fingers on a bottom of the lock pivot, which fingers are adapted to detachably engage with a catch attached to a floor of the housing, and which fingers will disengage with the catch when the lock pivot is depressed.

15. The sealed lever latch of claim 10, further comprising a key lock that engages with lock pivot and can be selected locked and unlocked, and wherein in the locked mode when the handle is in the first position, the lock pivot will be prevented from being depressed so that the handle cannot move to the second position where the paddle portion of the handle swings away from the housing.

16. The sealed lever latch of claim 10, wherein the a lever carriage has two spaced apart extensions with a space therebetween into which an end of the fastener lever fits, and with a bolt passing through the two spaced apart extensions and the end of the lever to retain the lever carriage and the fastener lever.

17. The sealed lever latch of claim 10, further comprising a fastener lever extending from the lever carriage below the housing, wherein the lever carriage and the fastener lever are separate components, and fastener lever is detachably attached to the lever carriage and the fastener lever are provided in a length and reach as desired for a particular application.

* * * * *